US008755531B2

(12) United States Patent
Bergere

(10) Patent No.: US 8,755,531 B2
(45) Date of Patent: Jun. 17, 2014

(54) AUDIO SYSTEM AND METHOD OF OPERATION THEREFOR

(75) Inventor: Julien Laurent Bergere, Sai Kung (HK)

(73) Assignee: Koninklijke Philips N.V. (NL)

( * ) Notice: Subject to any disclaimer, the term of this patent is extended or adjusted under 35 U.S.C. 154(b) by 621 days.

(21) Appl. No.: 13/055,487

(22) PCT Filed: Jul. 23, 2009

(86) PCT No.: PCT/IB2009/053206
§ 371 (c)(1),
(2), (4) Date: Jan. 24, 2011

(87) PCT Pub. No.: WO2010/013180
PCT Pub. Date: Feb. 4, 2010

(65) Prior Publication Data

US 2011/0116641 A1 May 19, 2011

(30) Foreign Application Priority Data

Jul. 28, 2008 (EP) ..... 08161257

(51) Int. Cl.
*H04R 5/00* (2006.01)

(52) U.S. Cl.
USPC ..... 381/27; 381/20

(58) Field of Classification Search
CPC ..... H04R 5/00; H04R 5/02; H04R 2205/026; H04S 1/00; H04S 1/002; H04S 3/00; H04S 3/002; H04S 5/00; H04S 5/005; H04S 5/02; H04S 2400/01; H04S 2400/03; H04S 2400/05; H04S 2400/07; H04H 20/88; H04H 20/89; G01L 19/008
USPC ..... 381/17, 300, 303–308, 18–23, 27; 369/1, 4, 5
See application file for complete search history.

(56) References Cited

U.S. PATENT DOCUMENTS

| | | | | |
|---|---|---|---|---|
| 4,497,064 | A | 1/1985 | Polk | |
| 4,630,298 | A | 12/1986 | Polk et al. | |
| 5,610,986 | A * | 3/1997 | Miles | 381/27 |
| 5,764,777 | A * | 6/1998 | Goldfarb | 381/27 |

(Continued)

FOREIGN PATENT DOCUMENTS

| | | | |
|---|---|---|---|
| DE | 4327200 | A1 | 2/1995 |
| EP | 1171039 | B1 | 1/2002 |
| EP | 1871143 | A1 | 12/2007 |

*Primary Examiner* — Davetta W Goins
*Assistant Examiner* — Daniel Sellers
(74) *Attorney, Agent, or Firm* — Jones Day

(57) ABSTRACT

An audio system receives a multi-channel signal which is fed to a controller (121) that generates a first drive signal for a first sound emitter (111) by combining signals of a plurality of the channels. The first drive signal has a signal component contribution from a first bandwidth of each channel of the multi-channel signal. The multi-channel signal is also fed to another controller (115) which generates second drive signals for second sound emitters (101-109). The second drive signals are generated from a single channel signals of the multi-channel signal and in a second bandwidth having a lower cut-off frequency which is above 950 Hz for a 3 dB gain attenuation relative to an average gain for a frequency band extending 1 kHz above the lower cut-off frequency and higher than a lower cut-off frequency of the first bandwidth. A delay processor (125) introduces a delay for signal components of the first drive signal relative a corresponding second drive signal.

15 Claims, 4 Drawing Sheets

(56) References Cited

U.S. PATENT DOCUMENTS

| | | | | |
|---|---|---|---|---|
| 5,854,847 | A * | 12/1998 | Yoshida et al. | 381/302 |
| 6,118,876 | A | 9/2000 | Ruzicka | |
| 6,819,767 | B1 * | 11/2004 | Funahashi et al. | 381/27 |
| 7,158,642 | B2 | 1/2007 | Tsuhako | |
| 7,218,740 | B1 | 5/2007 | Kowaki | |
| 7,315,619 | B2 | 1/2008 | Marton et al. | |
| 2004/0037433 | A1 | 2/2004 | Chen | |
| 2007/0253575 | A1 * | 11/2007 | Melanson | 381/97 |
| 2007/0288110 | A1 * | 12/2007 | Inoue et al. | 700/94 |

* cited by examiner

AUDIO SYSTEM AND METHOD OF OPERATION THEREFOR

FIELD OF THE INVENTION

The invention relates to an audio system and method of operation therefor and, in particular, but not exclusively to a surround sound audio reproduction system.

BACKGROUND OF THE INVENTION

Audio systems recreating multi-channel sound has become popular in the last decade and in particular consumer sound systems such as surround sound systems have become prevalent, e.g. for use in Home Theatre Systems.

However, a perceived disadvantage of such systems is the impracticability of having to place a relatively large number of speakers at different locations to generate the desired sound space. Indeed, for most consumers, situating several large speakers in a room in order to reproduce convincing multi-channel sound is not always desirable or feasible (visual impact, cables, absence of suitable locations for the speakers etc). Indeed, speakers are often considered unsightly and therefore systems have been developed which seek to minimize the visual impact of the speakers by making these as small as possible. Specifically, systems have been developed wherein lower frequencies are fed to a subwoofer which is common for all channels whereas the higher frequencies are produced by individual satellite speakers for each channel. As the satellite speakers need only reproduce the higher frequencies they can be made substantially smaller.

However, the speakers are still of a size where they tend to be noticeable and therefore it is desired to further reduced the size of these speakers. Also, in order to achieve a sufficiently high audio quality from the speakers, relatively high quality speakers must be used thereby adding cost to the system. Furthermore, the reduction in speaker size is often limited by the desired audio quality and many systems using small speakers tend to have a relatively low audio quality.

Specifically, the bandwidth covered by the satellite speakers currently extends down to a relatively low frequency of around 100 Hz-150 Hz (allowing the subwoofer to render the lower frequency signals) which tends to require relatively large speakers for high quality sound reproduction. Furthermore, although size and cost may be reduced by a higher cut-off frequency of e.g. 200 Hz or higher, this tends to result in a reduced audio quality of the system as a whole as a higher proportion of the frequency band is supported by the subwoofer.

Specifically, this tends to reduce the spatial perception and to reduce the perceived sound stage for the multi-channel system. For example, sound objects, such as voices, tend to be perceived as being heard partly through the subwoofer for the lower tones and partly through the satellites for the higher tones. This may result in both a perceived change of location of the sound objects as well as a reduced sound stage or spatial perception as a whole.

Furthermore, in order to generate sufficiently high sound levels from the satellite speakers a relatively high power level tends to be required for each satellite speaker.

Hence, an improved multi-channel audio system would be advantageous and in particular a system allowing reduced speaker size, reduced power consumption, reduced speaker cost, improved audio quality, improved spatial perception, facilitated implementation and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided an audio system for rendering a multi-channel signal, the apparatus comprising: means for receiving the multi-channel signal; first feed means for generating a first drive signal for a first sound emitter by combining signals of a plurality of channels of the multi-channel signal, the first drive signal having a signal component contribution from a first bandwidth of each channel of the multi-channel signal; second feed means for generating second drive signals for a set of second sound emitters, each of the second drive signals being generated from a single channel signal of one channel of the multi-channel signal and in a second bandwidth having a lower cut-off frequency which is higher than a lower cut-off frequency of the first bandwidth; and means for introducing a delay for at least one signal component of the first drive signal relative to at least a corresponding second drive signal; and wherein the lower cut-off frequency of the second bandwidth is higher than 950 Hz for a 3 dB gain attenuation relative to an average gain for a frequency band extending 1 kHz above the lower cut-off frequency.

The invention may allow an improved audio system. In particular, a reduced size of the second sound emitters, which e.g. may be satellite speakers, can be achieved. An improved sound quality can typically be achieved for smaller speakers and in particular an improved spatial perception can often be achieved. The invention may in many embodiments allow a reduced cost for speakers in order to achieve a perceived audio quality level.

The approach may in many embodiments substantially reduce the feed power required by the second sound emitters and may accordingly reduce the power consumption of any second sound emitter arrangement. Specifically, each of the second sound emitters may be an individual speaker arrangement comprising amplification means (e.g. to allow a wireless sound data transfer) and the power consumption thereof may be substantially reduced. For example, in some embodiments, the invention may allow the practical use of battery driven wireless satellite speakers for a spatial audio system.

In particular, the system may allow the second sound emitters to render signals only in a second bandwidth whereas a common speaker may use a common signal to extend this frequency bandwidth as well as optionally to further contribute to the perceived signal for the first bandwidth.

The invention may allow the contribution of the first sound emitter to the perception of the individual channels to be provided in a frequency band which may be relevant for the listener's spatial perception and specifically for perceiving a direction or location for specific sound objects. Specifically, the delay may be used to ensure that the directional perception is dominated by the signal contribution from the second sound emitters rather than from the first sound emitter. In particular, the delay may ensure that signal components from the second sound emitters reach the listener before corresponding signal components from the first sound emitter reach the listener. Accordingly, the system may exploit a human perception effect known as the Haas effect and which reflects that the human brain tends to associate the direction of incoming sound with the first wave front it receives and tends to ignore secondary wave fronts that tend to be interpreted as wall reflections and reverberation.

The approach may allow very small and/or efficient higher frequency sound transducers to be used for the second sound emitters thereby allowing reduced physical dimensions and reduced power requirements. In particular, by limiting the second drive signals to frequencies around 1 kHz and above, the requirements for the second sound emitters may be reduced substantially. Furthermore, the perceived impact of this bandwidth limitation for the individual signals may be reduced by the sound being radiated from the first sound emitter while allowing the spatial perception to be dominated by sound signals from the second sound emitters.

The multi-channel may for example be a stereo signal or a surround signal containing e.g. 5 or 7 spatial channels. In some embodiments, the multi-channel signal may have an associated Low Frequency Effects (LFE) channel.

The same criterion for determining a bandwidth may be used for the first and second bandwidth. Specifically, both bandwidths may be defined by X-dB cut-frequencies where X may be any value including e.g. 3 or 6.

The delay may be introduced at any stage such as e.g. by delaying the first drive signal and/or by delaying one or more of the signals of the plurality of channels before the combining. The at least one signal component may specifically be the contribution to the first drive signal from the corresponding second speaker drive signal.

In accordance with an optional feature of the invention, the audio system further comprises: the first sound emitter; means for feeding the first drive signal to the first sound emitter; the set of second sound emitters; and means for feeding a second drive signal to each of the set of second sound emitters.

This may allow an improved audio system. In particular smaller speakers, improved audio quality, reduced cost and/or reduced power consumption may be achieved. In the system, the first sound emitter may be a larger and/or higher quality speaker whereas the second sound emitters may be small satellite speakers. The arrangement may for example allow the first sound emitter to be a centrally located high power, high quality and relatively large speaker whereas the second sound emitters may be relatively small speakers located at desired locations for the spatial sound generation. For example, the second sound emitters may be arranged in a spatial surround sound configuration.

In accordance with an optional feature of the invention, the first sound emitter is a full bandwidth speaker whereas the second sound emitters are reduced bandwidth speakers.

This may allow reduced size and/or cost and/or power consumption of speakers while still allowing a high audio level and/or high quality. Furthermore, high spatial performance may be allowed.

A full bandwidth speaker may be a speaker which covers the entire audio bandwidth to a degree that no significant and easily perceivable distortion is introduced by the frequency response of the speaker whereas a reduced bandwidth speaker may have a frequency response that results in a substantial and easily noticeable distortion in at least part of the audio band. A full bandwidth speaker may e.g. cover a frequency range of at least 100 Hz to 4 kHz whereas a reduced bandwidth speaker may not cover a frequency band below a frequency X which is higher than 200 Hz.

In accordance with an optional feature of the invention, each of the second sound emitters is a tweeter having an efficiency of at least 84 dB SPL/1 W/1 m.

This may allow reduced size and/or cost and/or power consumption of speakers while still allowing a high audio level and/or high quality. In particular, the drive power requirements for the individual second sound emitter may be substantially reduced e.g. allowing battery driven operation. The tweeter may for example have a 3 dB lower cut-off frequency of 500 Hz or above, or preferentially in many embodiments of around 1 kHz or above.

The tweeter may specifically have an efficiency of at least 84 dB SPL/1 W/1 m measured in an IEC (International Electrotechnical Commission) baffle according to IEC standard 268.

In accordance with an optional feature of the invention, the audio system further comprises: means for receiving a microphone signal from a microphone; means for determining a first sound delay from the first sound emitter to the microphone in response to the microphone signal; means for determining at least a second sound delay from a second sound emitter to the microphone in response to the microphone signal; and means for determining the delay in response to the first sound delay and the second sound delay.

This may allow improved and/or facilitated operation. In particular, it may allow the delay to be accurately and automatically set to match the current conditions and audio emitter setup. The microphone may specifically be set at a typical (or e.g. worst case) listening location.

In some embodiments the audio system may comprise: means for receiving a microphone signal from a microphone; means for determining a first sound level from the first sound emitter at the microphone in response to the microphone signal; means for determining at least a second sound level from a second sound emitter at the microphone in response to the microphone signal; and means for determining an audio level setting for at least one of the first drive signal and a second drive signal for the second sound emitter in response to the first sound level and the second sound level.

This may allow improved and/or facilitated operation. In particular, it may allow the radiated sound levels to be accurately and automatically set to match the current conditions and audio emitter setup. The microphone may specifically be set at a typical (or e.g. worst case) listening location.

In accordance with an optional feature of the invention, the first sound emitter comprises a plurality of sound emitting elements for radiating a sound signal for the first drive signal.

This may allow an improved performance and may in particular allow the spatial perception to be increasingly determined by sound radiated from the second sound emitter elements rather than from the first sound emitter. In particular, it may allow the sound of the first sound emitter to be spread or radiated in different directions. Alternatively or additionally it may allow an attenuation in the radiated pattern towards a direct path between the first sound emitter and a listening position. For example, the sound emitting elements may be arranged in a dipole configuration. The radiated sound from the first sound emitter may be directed in two beams e.g. directed towards side walls. The approach may e.g. allow an increasing significance of reflected signals. Specifically, the plurality of sound emitting elements may be arranged to provide a more diffuse sound from the first sound emitter to reach the listener thereby reducing the impact on the listener's spatial perception relative to sound signals from the second emitters.

The plurality of sound emitting elements may specifically operate in the same frequency bandwidth. Thus, the bandwidth of the signals fed to each sound emitting element may be substantially the same.

In accordance with an optional feature of the invention, the audio system is arranged to radiate a sound signal from the first sound emitter for the first drive signal in a plurality of audio beams in different directions.

This may allow an improved performance and may in particular allow the spatial perception to be increasingly determined by sound radiated from the second sound emitter elements rather than from the first sound emitter. In particular, it may allow the sound of the first sound emitter to be spread or radiated in different directions. Alternatively or additionally, it may allow an attenuation in the radiated pattern towards a direct path between the first sound emitter and a listening position. The radiated sound from the first sound emitter may be directed in two or more beams e.g. directed towards side walls. The approach may e.g. allow an increasing significance of reflected signals. Specifically, the sound radiation may be arranged to provide a more diffuse sound from the first sound emitter to reach the listener thereby reducing the impact on the listener's spatial perception relative to sound signals from the second emitters.

In accordance with an optional feature of the invention, the audio system is arranged to radiate a diffuse sound signal from the first sound emitter for the first drive signal This may allow an improved performance and may in particular allow the spatial perception to be increasingly determined by sound radiated from the second sound emitters rather than from the first sound emitter.

In accordance with an optional feature of the invention, the second bandwidth has an overlapping frequency band with the first bandwidth.

The system may allow the second sound emitters to render signals only in a second bandwidth whereas a common speaker may use a common signal to extend this frequency bandwidth as well as to further contribute to the perceived signal in the overlapping band. The contribution of the combined signal in the second bandwidth may specifically reduce the requirements for the signals generated by the second sound emitters including the required sound level and/or quality level thereby allowing cheaper, and/or smaller speakers to be used for a given perceived quality and/or sound level. Furthermore, the contribution of the first sound emitter to the perception of the individual channels may be provided in a frequency band which is typically associated with a high significance for spatial perception and specifically for perceiving a direction or location for specific sound objects. Specifically, the delay may be used to ensure that the directional perception is dominated by the signal contribution from the second sound emitters rather than from the first sound emitter. In particular, the delay may ensure that signal components in the overlapping band from the second sound emitters reach the listener before corresponding signal components from the first sound emitter reach the listener. Accordingly, the system may exploit a human perception effect known as the Haas effect and which reflects that the human brain tends to associate the direction of incoming sound with the first wave front it receives and tends to ignore secondary wave fronts that tend to be interpreted as wall reflections and reverberation.

The overlapping frequency band may have a bandwidth of at least 1 kHz.

This may allow improved performance and/or operation and/or implementation. Specifically, it may allow a strong contribution to the signals from the second audio emitters by the first audio emitter thereby allowing reduced speaker size, reduced power consumption, reduced cost and/or increased audio quality. In some embodiments, particular advantageous performance can be achieved for an overlapping bandwidth of more than 4 kHz.

In accordance with an optional feature of the invention, the first bandwidth has a lower 3 dB cut-off frequency below 350 Hz and a higher 3 dB cut-off frequency above 800 Hz.

This may allow improved performance and/or operation and/or implementation. Specifically, it may allow a strong contribution to the perception of the individual channels by the radiated sound from the first sound emitter as well as a high quality of the audio signal for lower frequencies. This may allow reduced speaker size, reduced power consumption, reduced cost and/or increased audio quality.

In some embodiments, particular advantageous performance may be achieved for a lower 3 dB cut-off frequency of less than 200 Hz or even 150 Hz.

In accordance with an optional feature of the invention, the combining of signals is by a summation of the signals of the plurality of channels of the multi-channel signal.

This may allow facilitated implementation and/or operation while providing a suitably high audio quality. The combining may be of scaled signals.

In accordance with an optional feature of the invention, the delay exceeds a sound traveling time for a maximum distance between the first sound emitter and the sound emitters.

This may allow improved performance and may in particular provide an improved spatial perception by ensuring that signal components from the second speakers are received by a listener prior to the corresponding signal components being received from the first sound emitter.

In accordance with an optional feature of the invention, the delay is between 0.5 ms and 30 ms.

This may allow improved performance and may in particular provide an improved spatial perception.

In accordance with an optional feature of the invention, the audio system further comprises: means for generating a low frequency drive signal by combining and low pass filtering signals of the plurality of channels of the multi-channel signal; wherein at least part of the bandwidth of the low frequency drive signal is below the lower cut-off frequency of the first bandwidth.

This may allow improved performance in many embodiments and may in particular allow a given low frequency quality level to be achieved while keeping the size of the first sound emitter relatively low.

In accordance with an optional feature of the invention, the audio system is a surround sound audio system and the plurality of channels of the multi-channel signal are surround sound spatial channels.

The invention may provide an improved surround sound system and may in particular allow a surround sound system having reduced satellite speaker sizes, reduced satellite speaker power consumption, reduced cost and/or improved audio quality and in particular improved spatial perception.

According to another aspect of the invention there is provided a method of rendering a multi-channel signal, the method comprising: receiving the multi-channel signal; generating a first drive signal for a sound emitter by combining signals of a plurality of channels of the multi-channel signal, the first drive signal having a signal component contribution from a first bandwidth of each channel of the multi-channel signal; generating second drive signals for a plurality of sound emitters, each of the second drive signals being generated from a single channel signal of one channel of the multi-channel signal and in a second bandwidth having a lower cut-off frequency higher than a lower cut-off frequency of the first bandwidth; and introducing a delay for at least one signal component of the first drive signal relative to at least a corresponding second drive signal; wherein the lower cut-off frequency of the second bandwidth is higher than 950 Hz for a 3 dB gain attenuation relative to an average gain for a frequency band extending 1 kHz above the lower cut-off frequency.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to a surround sound system comprising three or more spatial channels. However, it will be appreciated that the invention is not limited to this application but may be applied to many other systems including for example stereo systems.

Figure 1:
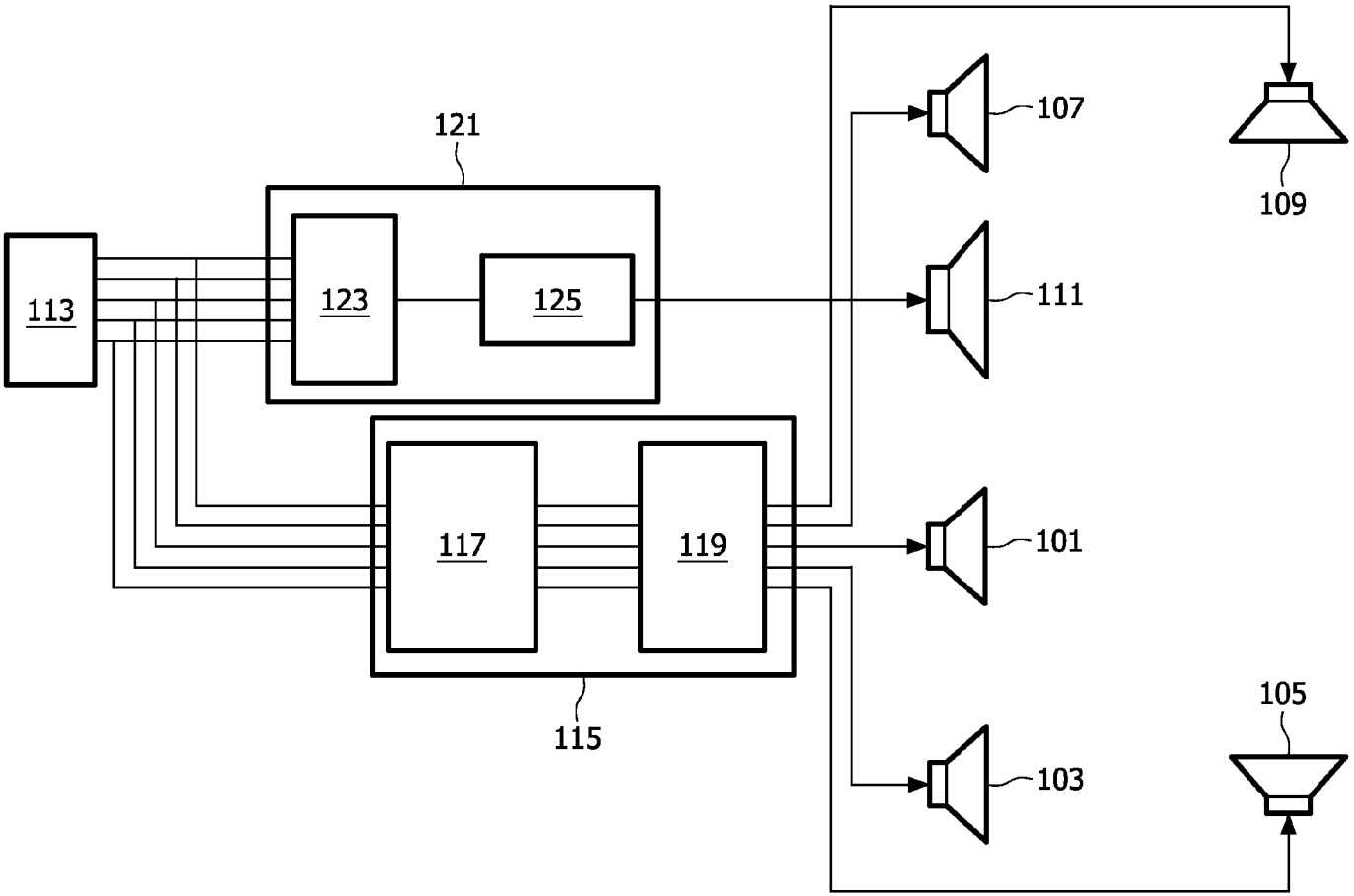
FIG. 1 illustrates an example of an audio system in accordance with some embodiments of the invention.

FIG. 1 illustrates an example of an audio system in accordance with some embodiments of the invention.

The system comprises a set of satellite speakers 101-109 arranged in a surround configuration. In the system, each of the satellite speakers 101-109 is arranged to radiate sound waves representing a spatial channel of a five channel surround signal. Specifically, one speaker 101 may represent a centre channel, another speaker 103 the left front signal, another speaker 105 the left rear signal, another speaker 107 the right front signal and another speaker 109 the right rear signal.

In the system, the generated surround sound audio experience is furthermore supported by a main speaker 111 which radiates a sound signal generated by combining the signals from the individual spatial channels. Thus, whereas the sound signals radiated from the individual satellite speakers 101-109 correspond to an individual spatial channel of the multi-channel system, the sound signal radiated from the main speaker 111 is a common signal which specifically may comprise the signals from all of the spatial channels.

The audio system of FIG. 1 comprises a receiver 113 which receives the multi-channel signal from a source which may be an external or internal source. Furthermore, the multi-channel signal may be a streaming real-time signal or may be retrieved from a signal store which specifically may be a storage medium such as a Compact Disc (CD) or Digital Versatile Disc (DVD).

The multi-channel signal is fed to a first speaker controller 115 which is arranged to generate drive signals for the satellite speakers 101-109. Specifically, the first speaker controller 115 processes each of the channels independently and separately from the other channels. Each of the channels of the multi-channel signal is specifically filtered by a filter processor 117 of the first speaker controller 115 to reduce the bandwidth. Specifically, a high pass filtering is introduced to limit the bandwidth (henceforth referred to as satellite speaker bandwidth) of the frequency response experienced by each spatial channel signal to a high frequency bandwidth. In the example, each filtered spatial channel signal is then individually amplified by a set of mono-amplifiers 119 before being fed directly to a single spatial satellite speaker 101-109.

The multi-channel signal is furthermore fed to a second speaker controller 121 which is coupled to the receiver 113 and the main speaker 111 and is arranged to generate a drive signal for the main speaker 111.

The main signal is generated by combining two or more of the spatial channels, and specifically in the example, by combining the signals of all of the spatial channels into a single signal. The frequency response of the second speaker controller 121 furthermore has a bandwidth (henceforth referred to as the main speaker bandwidth) which in the example includes lower frequencies than that of the satellite speaker bandwidths.

Specifically, in the system the satellite speaker bandwidths are restricted to a bandwidth of around 1 kHz and upwards whereas the bandwidth of the audio channels below 1 kHz is predominantly covered by the main speaker bandwidth. More specifically, the satellite speaker bandwidths have a lower cut-off frequency which is higher than 950 Hz for a 3 dB gain attenuation relative to an average gain for a frequency band extending 1 kHz above the lower cut-off frequency. Thus, the lower cut-off frequency corresponds to the frequency at which the gain has dropped 3 dB relative to the average gain for a 1 kHz bandwidth of the pass band of the second speaker controller 121 (with the pass band being considered to start at the lower cut-off frequency).

By limiting the signals fed to the satellite speakers 101-109 to frequencies above around 1 kHz the requirements for the satellite speakers 101-109 can be relaxed substantially. In particular, this may allow substantially smaller speaker elements to be used and/or may allow substantially more efficient speaker elements to be used. For example, very efficient high frequency and high efficiency speakers may be used. This may furthermore substantially reduce the power levels required to drive the satellite speakers 101-109 for a given sound level. This may e.g. be sufficient to allow integrated power amplifier and speaker units to be used that can practically be driven by a battery power source.

The bandwidth of the signal below the satellite speaker bandwidths (i.e. below 1 kHz) is in the specific example handled by the combined sound signal radiated from the main speaker 111. Thus, in the system a substantial part of the audio spectrum for the individual channels is not provided by the individual satellite speakers 101-109 for the channel but rather by a combined signal radiated from one speaker location. This may ensure that the perceived degradation of restricting the satellite speakers 101-109 to very high frequencies may be substantially reduced.

In the specific example, the main speaker bandwidth is larger than the satellite speaker bandwidth but is overlapping with this. Specifically, the second speaker controller 121 may not include any filtering in the audio band and thus the main speaker bandwidth may be a full bandwidth.

Figure 2:
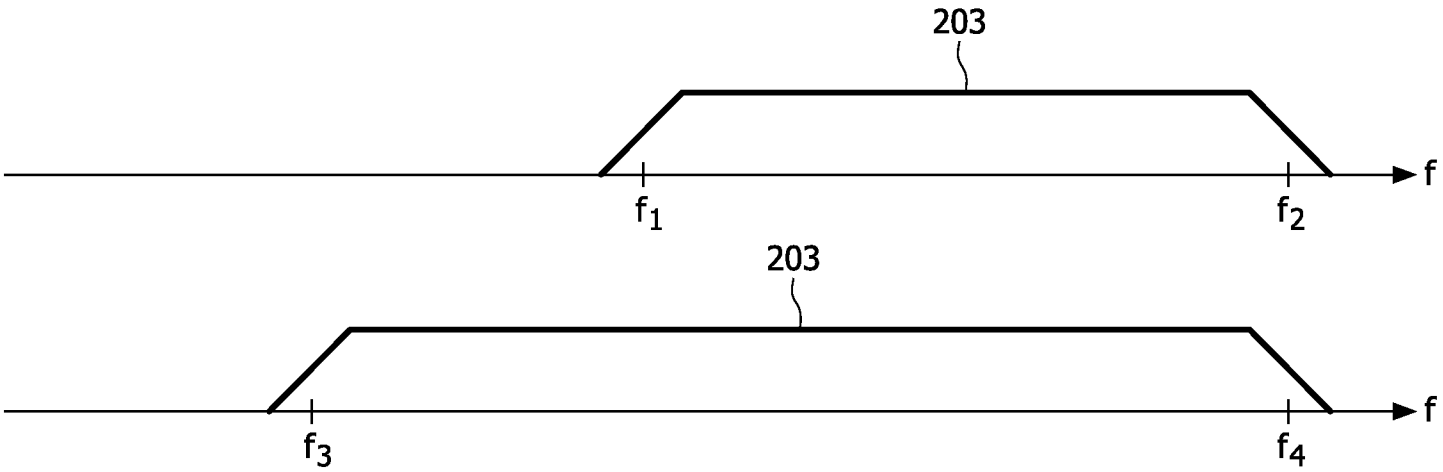
FIG. 2 illustrates an example bandwidths of elements of an audio system in accordance with some embodiments of the invention.

FIG. 2 illustrates an example of possible bandwidths in the system of FIG. 1. Specifically, FIG. 2 illustrates a possible main speaker bandwidth 201 and satellite speaker bandwidth 203 for a scenario wherein the bandwidth 203 of the spatial channel signals is reduced for the satellite speakers 101-109 by high pass filtering. It will be appreciated that in other embodiments, the frequency bandwidths may not overlap. For example, the upper cut-off frequency of the main speaker bandwidth 201 may substantially correspond to the lower cut-off frequency of the satellite speaker bandwidth 203.

In the specific example of FIG. 1, a first frequency band ($f_3$ to $f_1$) is supported substantially by radiation of sound only from the main speaker 111. This frequency band corresponds to the frequency band within the main speaker bandwidth but not within the satellite speaker bandwidth. A second frequency band (above $f_1$) is supported by radiation of sound from both the main speaker 111 and from the satellite speakers 109-111. This frequency band corresponds to frequencies within both the satellite speaker bandwidth 203 and the main speaker bandwidth 201.

In some embodiments, a third frequency band (e.g. comprising very high frequencies, such as frequencies above, say, 5 kHz) corresponding to frequencies in the satellite speaker bandwidth 203 but not in the main speaker bandwidth 201 may be supported only by the satellite speakers 101-109. However, in other embodiments, the main speaker 111 may support all frequencies also supported by the satellite speakers 101-109.

In the second frequency band, henceforth referred to as the shared band, the sound reaching a listener is generated both from the main speaker 111 and the satellite speakers 101-109. Thus, in the shared frequency band, a given sound level may be achieved with a reduced signal level for the satellite speakers 101-109 when compared to a situation wherein signals are only generated by the satellite speakers 101-109.

In the system, a relatively small delay is furthermore introduced for the drive signal for the main speaker 111. The delay may for example be introduced by delaying the main speaker drive signal after combining the spatial channel signals or may e.g. be achieved by delaying the spatial channel signals prior to these being combined. Specifically, in the system, the second speaker controller 121 comprises a combiner 123 which sums the individual spatial channel signals into a single combined mono signal. The combiner 123 is coupled to a delay processor 125 which is arranged to delay the combined mono signal before this is fed to the main speaker 111.

In the system, the radiated sound of the main speaker 111 is delayed relative to the satellite speakers 101-109 such that the sound from any of the satellite speakers 101-109 reaches the listener(s) before the sound from the main speaker 111. Specifically, any wave front for a sound object being rendered in both the main speaker 111 and one of the satellite speakers 101-109 will first reach the listener(s) from the satellite speaker and subsequently from the main speaker 111 (e.g. the main speaker 111 and the satellite speakers 101-109 may render different frequencies of the wave front).

This approach may be used to ensure that although the sound reaching the user is generated from the individual satellite speakers 101-109 and from a main speaker 111, the spatial perception will be dominated by the location of the satellite speakers 101-109. Thus, the impact of the main speaker 111 on the spatial perception may be substantially reduced. Specifically, the system may exploit the Haas effect to maintain the spatial perception despite part of the signal actually being generated by a shared speaker located at a different position than where the sound should be perceived to come from.

The Haas effect is a psychoacoustic effect related to a group of auditory phenomena known as the Precedence Effect or law of the first wave front. These effects, in conjunction with sensory reaction(s) to other physical differences (such as phase differences) between perceived sounds, are responsible for the ability of listeners with two ears to accurately localize sounds coming from around them.

When two identical sounds (i.e. identical sound waves of the same perceived intensity) originate from two sources at different distances from the listener, the sound created at the closest location is heard (arrives) first. To the listener, this creates the impression that the sound comes from that location alone due to a phenomenon that might be described as "involuntary sensory inhibition" in that one's perception of later arrivals is suppressed.

Thus, in an embodiment wherein the frequency band up to around 1 kHz (or higher) is predominantly covered by radiation of a single combined signal from one location (the main speaker 111) and the frequency band from around 1 kHz (or higher) is predominantly covered by radiation of a the individual signals from different locations (the satellite speakers 101-109), the individual signals from the different locations will be given a higher spatial perceptual weight by the listener. Thus, whereas a large part of the spatial information is removed by the combination of frequencies below 1 kHz (or higher) this is substantially mitigated. Indeed, this is achieved despite the spatial information being removed from a frequency band which is typical significant for the spatial perception.

In the specific example of FIG. 1 wherein overlapping frequencies are used, the entire frequency spectrum for all of the incoming multi-channel spatial signals is reproduced by a main, wideband, loudspeaker 111. This speaker may be relatively large to ensure a high quality and/or the ability to provide high sound levels. For example, the main speaker 111 may be the size of a typical, conventional HiFi speaker. Thus, in the example the main speaker is a full bandwidth speaker that covers the entire audio bandwidth with a reasonable quality. For example, the main speaker 111 may have a 3 dB bandwidth exceeding the range from 100 Hz to 6 kHz. The main speaker 111 may be centrally placed in the intended sound stage and may specifically provide a rather diffuse, room-filling sound image Furthermore, in the system, the individual spatial channels are also partly reproduced by satellite speakers 101-109 which specifically are miniature high-frequency satellite units (e.g. using tweeters as transducers) distributed in the room at locations suitable for providing the spatial sound experience. The satellite speakers 101-109 only produce sound in a limited bandwidth which may furthermore be shared with the main speaker 111 such that the sound reaching the listener for this shared bandwidth is a mixed signal comprising corresponding signal components from both the main speaker 111 and the satellite speakers 101-109. Thus, the satellite speakers 101-109 may be reduced bandwidth speakers which are only suitable for generating a quality/sound level above a given threshold in a sub-bandwidth of the audio bandwidth range.

Thus, in the system, the high frequency satellite speakers 101-109 reproduce the higher part of the spectrum of each individual spatial channel. Furthermore, in the specific example a contribution to the higher part of the spectrum is also provided by the main speaker 111 in addition to the reproduction of the lower parts of the spectrum of the spatial channels. Specifically, the feed signal for the main speaker 111 is generated as the sum of all the spatial channel signals which is then delayed relative to the corresponding signal components in the spatial channels. The delay may specifically be such that at any relevant listening position, the first incoming wave front for a sound object is from the corresponding satellite speaker rather than from the main speaker 111.

Accordingly, the Haas effect ensures that the perceived sound direction for the sound object is predominantly determined by the signal from the satellite speakers 101-109 rather than the component received from the main speaker 111.

Since the satellite speakers 101-109 need only produce at a higher frequency range and in addition need only produce a relatively lower sound level than for conventional systems, more efficient and smaller sound transducers can be used for these speakers. In particular, rather than using wideband and therefore low-efficiency (typically around 75 dB/1 W/1 m) speakers, the approach allows the use of high efficiency and very small satellite speakers 101-109. Specifically, the satellite speakers 101-109 may be used only for frequencies higher than 1 kHz and may be implemented using high efficiency, miniature, neodymium magnet based tweeters. The high efficiency that can be achieved by such speakers (higher than 84 dB SPL/1 W/1 m and typically 90 dB SPL/1 W/1 m or more) allows the drive power to the satellite speakers 101-109 to be reduced very substantially. This may be even further reduced in the example wherein the main speaker 111 provides additional reinforcement of the audio signal in the shared frequency band. Indeed, the system allows for a practical implementation of systems wherein each satellite speaker is a single standalone, wireless, battery operated amplifier and sound transducer system. Thus, a surround sound implementation can be achieved wherein the main speaker system (e.g. comprising the drive functionality and the main speaker 111 itself) can be centrally positioned and coupled to a power source (e.g. the mains) whereas each satellite speaker can be implemented as a very small stand alone box that need not have any external wire connections whatsoever.

It will be appreciated that in some embodiments, only some of the spatial channels may be supported by the main speaker whereas other spatial channels may possibly not be supported by the main speaker. For example, in some embodiments, the left and right front channels may be supported by the main speaker 111 whereas the left and right surround channels may not be supported by the main speaker 111. It will also be appreciated that in some embodiments, not all spatial channels are supported by a separate satellite speaker 101-109. For example, in some embodiments, the central channel may only be supported by the main speaker 111 (which typically will be centrally located) and will not additionally be supported by an individual satellite speaker 101.

It will be appreciated that the exact bandwidths of the different signals and the exact value of the delay for the main speaker 111 signal may be optimized for the preferences and requirements of the individual embodiment. It will also be appreciated that any suitable criterion for determining the bandwidths may be used. For example, the bandwidth of the first and second speaker controllers 115, 121 may be determined as the frequency band in which the gain of the controller is above a threshold given as an offset from the gain of the frequency having the highest gain. For example, the bandwidth may be given as the frequency band above a lower cut-off frequency and below a higher cut-off frequency where the cut-off frequency is given as the frequency wherein the gain has dropped by a value of X dB relative to the maximum or average gain within the frequency bandwidth. The value X may for example be 3 dB or 6 dB. The same bandwidth criterion is used for both the first and second speaker controller 115, 121.

The lower cut-off frequency of the second bandwidth is higher than 950 Hz when the lower cut-off frequency is defined as the frequency for which there is a 3 dB gain attenuation relative to an average gain for the frequency band which extends 1 kHz above the lower cut-off frequency.

In many embodiments, the frequency bandwidth for the main speaker feed signal (i.e. of the second speaker controller 121) is advantageously fairly large and specifically has a lower 3 dB cut-off frequency below 350 Hz and a higher 3 dB cut-off frequency above 850 Hz. This may ensure that the audio signal generated by the main speaker 111 has a high audio quality. In particular, it may allow that the lower frequency components of all spatial channels are effectively reproduced while also ensuring that the main speaker 111 provides a substantial contribution to the reproduction of the spatial channels at the higher frequencies. In many embodiments, it may be advantageous to have an even larger bandwidth. In particular, the lower 3 dB cut-off frequency may in many embodiments advantageously be below 300 Hz, 200 Hz or even 100 Hz. Also, the higher 3 dB cut-off frequency may in many embodiments advantageously be above 1 kHz, 2 kHz, 4 kHz, 6 kHz, 8 kHz or even 10 kHz.

In many embodiments, the frequency bandwidth for the satellite speaker feed signals (i.e. of each channel of the first speaker controller 115) is advantageously fairly large but is limited to a higher frequency band and does not cover lower frequencies. In particular, the lower 3 dB cut-off frequency is advantageously at least above 300 Hz. Indeed, the lower 3 dB cut-off frequency may in many embodiments advantageously be above 400 Hz, 500 Hz, 600 Hz, 800 Hz or even 1 kHz. By restricting the bandwidth to the higher frequencies, the requirements for the satellite speakers 101-109 may be relaxed and in particular it may allow small and highly efficient speakers to be used for the spatial channels. Furthermore, in many embodiments, the frequency bandwidth for the satellite speaker feed signals (i.e. of each channel of the first speaker controller 115) advantageously extend to relatively high frequencies. In particular, in many embodiments the bandwidth may not be actively limited but rather the first speaker controller 115 may only comprise high pass filtering. Thus, in many embodiments, the higher 3 dB cut-off frequency for this bandwidth is at least 5 kHz and possibly at least 6 kHz, 7 kHz, 8 kHz or even 10 kHz.

Also, the frequency bandwidths of the first and second speaker controllers 115, 121 are arranged such that the overlap between the bandwidths is fairly substantial thereby ensuring that the contribution of the main speaker 111 to the perception of the spatial channels by the listener is substantial. In particular, the 3 dB frequency overlap is at least 2 kHz but may in other embodiments be at least 3 kHz, 4 kHz, 5 kHz or even 8 kHz.

It will also be appreciated that the delay may be set differently in different embodiments. Typically the delay will be set sufficiently high to ensure that the sound from the satellite speakers 101-109 reach the listener before the corresponding sound from the main speaker 111. In many embodiments, this is achieved by setting the delay higher than the time it takes for sound to travel the maximum distance between the main speaker 111 and any of the satellite speakers 101-109. In most embodiments, the delay will be set above at least 0.5 msecs to achieve attractive performance and in many embodiments a minimum delay of 1 msec, 2 msec, 3 msec or 4 msec will provide advantageous performance.

In many embodiments, the delay is set sufficiently high to ensure that the sound components from the satellite speakers 101-109 is received before the corresponding components from the main speaker 111 while at the same time being reduced as much as possible in order to reduce the perceptional impact of the delay. Specifically, the delay is advantageously in many embodiments kept below 30 ms as the Haas effect tends to reduce for higher delays resulting in the delayed sound components being increasingly perceived as separate echoes.

In some embodiments, the delay may be a fixed design parameter or may e.g. be set by a user input. In other embodiments, the system may comprise functionality for automatically or semi-automatically calibrating the delay.

Figure 3:
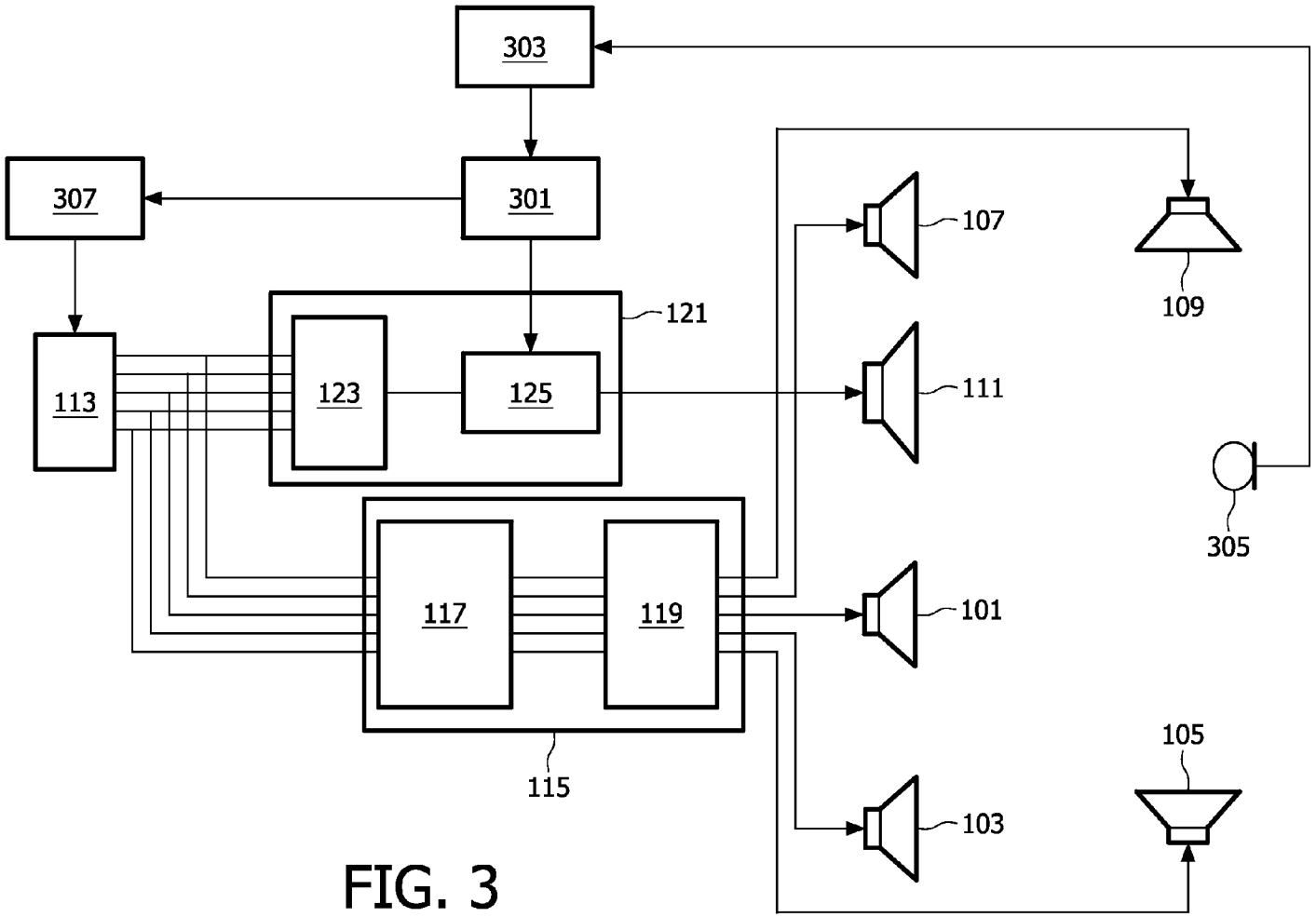
FIG. 3 illustrates an example of an audio system in accordance with some embodiments of the invention.

FIG. 3 illustrates the audio system of FIG. 1 further comprising functionality for calibrating the delay of the delay processor 125. Specifically, the audio system comprises a calibration controller 301 which is coupled to the delay processor 125 and which is further coupled to a microphone input 303 which itself is coupled to an external microphone 305.

The microphone 305 can be located at a desired listening position for which the delay is to be calibrated. The microphone signal is fed to the microphone input 303 which amplifies and filters the signal before feeding this to the calibration controller 301.

The audio system furthermore comprises a test signal generator 307 which is coupled to the calibrating controller 301 and the receiver 113. During a calibration process the calibration controller 301 controls the test signal generator 307 to inject a different test signal to each of the spatial channels. The test signals are accordingly fed to the satellite speakers 101-109. In addition the calibration processor may set the delay of the delay processor 125 to a maximum value, such as e.g. 40 msec.

The calibration processor 301 may then evaluate the received microphone signal and may perform a correlation between the microphone signal and delayed versions of each test signal. The correlation values for different values of the delay of each test signal are then compared to find two peak values for each test signal. For each test signal, the delay for the first correlation value peak will correspond to the delay from the corresponding satellite speaker 101-109 to the microphone 305. The delay for the second correlation value peak will correspond to the delay from the main speaker 111 to the microphone 305 (this will typically be around 40 msec later than the first correlation value peak due to the large delay introduced by the delay processor 125).

Thus, the approach allows a delay from each satellite speaker 101-109 to the listening position to be determined. These delays may be compared to identify the maximum delay. Furthermore, the delay from the main speaker 111 to the listening position is determined (e.g. the delays for the individual test signals may be averaged). A delay difference may then be determined by subtracting the delay for the main speaker 111 from the maximum delay for a satellite speaker 101-109 and the resulting delay may be considered the minimum delay for the delay processor 125 that will ensure that the sound components from the spatial speakers 101-109 reach the listening position before the sound components from the main speaker 111. Typically the calibration processor 301 will set the delay of the delay processor 125 with a suitable margin. For example, the delay of the delay processor 125 may be set two msecs higher than the determined minimum value.

It will be appreciated that other calibration processes can be used. For example, rather than a simultaneous parallel injection of test signals to the spatial channels, a calibration signal where a test signal is sequentially fed to each of the spatial channels while all other spatial channels are maintained silent may be used.

It will be appreciated that the same approach may alternatively or additionally be used to set the relative output levels for the main speaker 111 relative to one or more of the satellite speakers. Thus, the calibration controller 301 may measure the microphone signal level for the individual test signals and may use this to set the gain for the individual speaker 101-111 such that a desired relationship is achieved at the listening. For example, the gains may be set such that the audio level measured by the microphone 305 is the same for all speakers 101-111. This may for example allow an automated or semi-automated adaptation to the specific deployment scenario. For example, it may compensate for the main speaker 111 being located closer to the listener than the satellite speakers 101-109.

In the specific example, the main speaker 111 and/or the second speaker controller 121 is arranged to radiate a diffuse sound signal for the combined signal from the plurality of satellite speakers 101-109. Thus the operation of the system is arranged such that the sound signal is spread relative to a direct radiation from the location of the main speaker 111 to the listening position.

Specifically, the low-frequency enhancement signal can be generated by combining a low pass filtering of the spatial channels before amplifying and feeding these to the sub-woofer. As a specific example, the output of the combiner 123 may also be fed to a low pass filter with the output signal of this low pass filter being fed to the subwoofer.

Figure 4:
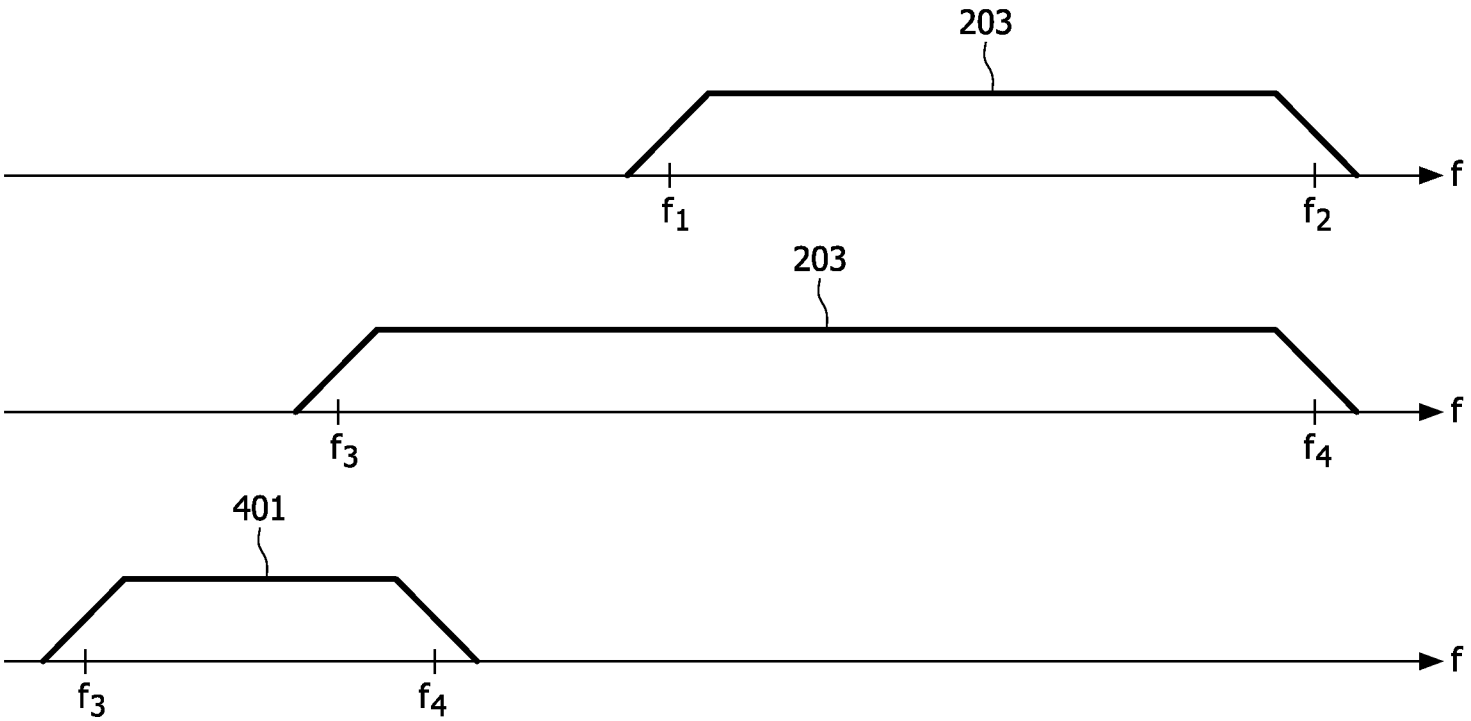
FIG. 4 illustrates an example bandwidths of elements of an audio system in accordance with some embodiments of the invention.

Furthermore, in such an embodiment, the combined signal may be high pass filtered before being fed to the delay processor 125. Thus, such an embodiment may result in a system wherein a low-frequency band is predominantly supported by the sub-woofer, a higher but still low frequency band is supported by both the sub-woofer and the main speaker 111, a mid range band is supported only by the main speaker 111 and a high range band is supported by both the main speaker 111 and the satellite speakers 101-109. Such an example is illustrated in FIG. 4 which in addition to FIG. 2 also illustrates a low frequency band 401 supported by the sub-woofer.

In the specific example, the main speaker 111 and/or the first speaker controller 121 is arranged to radiate a diffuse sound signal for the combined signal from the plurality of satellite speakers 101-109. Thus the operation of the system is arranged such that the sound signal is spread relative to a direct radiation from the location of the main speaker 111 to the listening position.

In some embodiments, the main speaker 111 may specifically comprise a plurality of speaker elements. For example, two speaker elements may be arranged in a dipole configuration such that the generated sound signal is radiated in predominantly two different audio beams. These audio beams may for example be directed away from a direct line from the main speaker 111 to the listening position. Specifically, the dipole configuration may provide a radiated directivity pattern which has two main directions (corresponding to two audio beams) that are directed sideways thereby increasing the impact of reflected audio signals reaching the listening position relative to direct audio signals.

As another example, the main speaker 111 may comprise an array of speaker elements and the first speaker controller 121 may be arranged to perform audio beamforming such that the combined audio signal is radiated in a plurality of beams where each beam has a different direction. The specific beam forming may for example be dynamically adapted to the specific audio environment. For example, the direction of beams may be adjusted depending on the distance and angle to walls that can reflect the sound towards the listening position.

Thus, in some embodiments, the combined sound signal in the main speaker bandwidth is fed to a plurality of speaker elements and/or is radiated in a plurality of audio beams such that an increased spreading of the signal is achieved. Accordingly, the combined sound signal will reach the listener from a number of different angles thereby providing a diffuse spatial impression. Thus, by using a diffuse sound radiation for the combined signal from the main speaker 111, the contribution of this signal to the spatial perception of the individual channels can be further reduced thereby resulting in an improved user experience.

It will be appreciated that the above description for clarity has described embodiments of the invention with reference to different functional units and processors. However, it will be apparent that any suitable distribution of functionality between different functional units or processors may be used without detracting from the invention. For example, functionality illustrated to be performed by separate processors or controllers may be performed by the same processor or controllers. Hence, references to specific functional units are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. An audio system for processing a multi-channel signal comprising:

a receiver for receiving the multi-channel signal and producing a plurality of channel signals corresponding to respective ones of said channels and having predetermined bandwidths;

a first controller for generating a first drive signal for a first sound emitter by combining all of the plurality of channel signals, the first drive signal including a signal component contribution from each of the plurality of channel signals and having a first bandwidth collectively including the predetermined bandwidths of the channel signals;

a second controller for generating a plurality of second drive signals for respective ones of a set of second sound emitters, each of the second drive signals being generated from a single one of the plurality of channel signals, said second drive signals collectively having a second bandwidth that overlaps part of the first bandwidth and has a lower cut-off frequency that is higher than a lower cut-off frequency of the first bandwidth;

said first controller including a delay processor for introducing a delay for at least one signal component of the first drive signal relative to a corresponding signal component in at least one of the second drive signals, said delay processor being adapted to adjust said delay to ensure that sounds transmitted from the second sound emitters reaches a listener before corresponding sounds from the first sound emitter;

where the lower cut-off frequency of the second bandwidth is higher than 950 Hz for a 3 dB gain attenuation relative to an average gain for a frequency band extending 1 kHz above the lower cut-off frequency of the second bandwidth.

2. The audio system of claim 1 where the first sound emitter is coupled to the first controller for receiving the first drive signal and the set of second sound emitters is coupled to the second controller for receiving the second drive signals.

3. The audio system of claim 2 where the first sound emitter comprises a full bandwidth speaker and the second sound emitters comprise reduced bandwidth speakers.

4. The audio system of claim 3 where each of the second sound emitters comprise a tweeter having an efficiency of at least 84 dB SPL/1 W/1 m.

5. The audio system of claim 2 comprising:

microphone disposed for receiving sound from the first sound emitter and producing a microphone signal representative of said sound;

a calibration controller coupled to the microphone for determining from the microphone signal:

a first sound delay from transmission by the first sound emitter to reception by the microphone; and at least a second sound delay from transmission by at least one of the second sound emitters to reception by the microphone;

said calibration controller effecting adjustment of the delay introduced by the delay processor in dependence on a difference between the first sound delay and the second sound delay.

6. The audio system of claim 2 where the first sound emitter comprises a plurality of sound emitting elements for radiating a sound signal for the first drive signal.

7. The audio system of claim 2 where the first sound emitter is adapted to radiate a sound signal for the first drive signal in a plurality of audio beams in different directions.

8. The audio system of claim 2 where the first sound emitter is adapted to radiate a diffuse sound signal for the first drive signal.

9. The audio system of claim 1 where the overlap of the first and second bandwidths extends over a frequency band of at least 1 kHz.

10. The audio system of claim 1 where the first bandwidth has a lower 3 dB cut-off frequency below 350 Hz and a higher 3 dB cut-off frequency above 6kHz.

11. The audio system of claim 1 where the delay exceeds a sound traveling time for a maximum distance between the first sound emitter and the sound emitters.

12. The audio system of claim 1 where the delay is between 0.5 ms and 30 ms.

13. The audio system of claim 1 comprising a signal combiner for generating a low frequency drive signal by combining and low pass filtering ones of the plurality of channel signals such that at least part of the bandwidth of the low frequency drive signal is below the lower cut-off frequency of the first bandwidth.

14. The audio system of claim 1 where the multi-channel signal comprises a plurality of surround sound spatial channels.

15. A method of processing a multi-channel signal, the method comprising:

receiving the multi-channel signal and producing a plurality of channel signals corresponding to respective ones of said channels and having predetermined bandwidths;

generating a first drive signal for a first sound emitter by combining all of the plurality of channel signals, the first drive signal including a signal component contribution from each of the plurality of channel signals and having a first bandwidth collectively including the predetermined bandwidths of the channel signals;

generating plurality of second drive signals for respective ones of a set of second sound emitters, each of the second drive signals being generated from a single one of the plurality of channel signals, said second drive signals collectively having a second bandwidth that overlaps part of the first bandwidth and having a lower cut-off frequency that is higher than a lower cut-off frequency of the first bandwidth; and introducing a delay for at least one signal component of the first drive signal relative to a corresponding signal component in at least one of the second drive signals, said delay being adjusted to ensure that sounds transmitted from the second sound emitters reaches a listener before corresponding sounds from the first sound emitter;

where the lower cut-off frequency of the second bandwidth is higher than 950 Hz for a 3 dB gain attenuation relative to an average gain for a frequency band extending 1 kHz above the lower cut-off frequency.

* * * * *